US009852662B2

(12) United States Patent
Williams

(10) Patent No.: US 9,852,662 B2
(45) Date of Patent: Dec. 26, 2017

(54) BEVERAGE TAG

(71) Applicant: Lori L. Williams, Mohrsville, PA (US)

(72) Inventor: Lori L. Williams, Mohrsville, PA (US)

(73) Assignee: Buttn Products, Inc., Mohrsville, PA (US)

( * ) Notice: Subject to any disclaimer, the term of this patent is extended or adjusted under 35 U.S.C. 154(b) by 0 days.

(21) Appl. No.: 14/961,008

(22) Filed: Dec. 7, 2015

(65) Prior Publication Data

US 2017/0162081 A1 Jun. 8, 2017

(51) Int. Cl.
*G09F 3/00* (2006.01)
*G09F 3/02* (2006.01)
*A47G 19/22* (2006.01)

(52) U.S. Cl.
CPC ..... *G09F 3/02* (2013.01); *A47G 19/2227* (2013.01); *G09F 2003/0272* (2013.01)

(58) Field of Classification Search
CPC . G09F 3/00; G09F 3/16; G09F 3/0288; G09F 2003/0273
USPC ..... 40/5
See application file for complete search history.

(56) References Cited

U.S. PATENT DOCUMENTS 2,002,609 A * 5/1935 Mygland ..... D05B 57/28 242/118.4
2,507,794 A * 5/1950 Longnecker ..... A44B 15/005 40/111
3,354,564 A * 11/1967 Falcone ..... B65D 23/14 40/310
3,574,963 A * 4/1971 Rosenow ..... A63B 60/62 150/160
5,339,549 A * 8/1994 David ..... G09F 23/06 283/114
5,509,632 A * 4/1996 Mesna ..... A47F 5/083 248/301
5,581,921 A * 12/1996 Hutchens ..... G09F 3/12 40/324
5,592,767 A * 1/1997 Treske ..... G09F 3/207 24/3.11
6,053,349 A * 4/2000 Griggs, Jr. ..... B65D 17/16 116/201
6,105,294 A * 8/2000 Goodfellow ..... G09F 3/20 206/39.5
D496,220 S * 9/2004 Miller ..... D7/387
7,028,424 B2 * 4/2006 Arroyo ..... G09F 3/16 40/306
7,578,084 B2 * 8/2009 Wu ..... G09F 11/04 40/495
8,516,727 B1 * 8/2013 Maraia ..... G09F 3/205 40/316
2001/0011431 A1 * 8/2001 Elias ..... G09F 3/00 40/306
2003/0150145 A1 * 8/2003 Kretzschmar ..... G09F 21/18 40/538
2004/0148827 A1 * 8/2004 Arroyo ..... G09F 3/16 40/306
2005/0091897 A1 * 5/2005 Lawrence ..... G09F 3/16 40/666

(Continued)

*Primary Examiner* — Shin Kim
(74) *Attorney, Agent, or Firm* — Barley Snyder

(57) ABSTRACT

A beverage identification device is provided and generally has an identification member, a rotation member rotatably attached to the identification member, and an attachment mechanism extending from the identification member.

25 Claims, 7 Drawing Sheets

(56) References Cited

U.S. PATENT DOCUMENTS

| | | | | |
|---|---|---|---|---|
| 2006/0207132 | A1* | 9/2006 | Vaughan | G09F 3/14 40/310 |
| 2008/0108455 | A1* | 5/2008 | Wu | G09F 11/04 473/407 |
| 2008/0222933 | A1* | 9/2008 | Wu | A63B 60/62 40/642.02 |
| 2009/0217558 | A1* | 9/2009 | Maier-Hunke | G09F 3/207 40/1.6 |
| 2011/0067278 | A1* | 3/2011 | Hulbert | B60J 3/0204 40/593 |
| 2013/0108190 | A1* | 5/2013 | Flowers | B65F 1/1415 383/73 |
| 2016/0007735 | A1* | 1/2016 | Gallup | A44B 11/2592 248/447.1 |

* cited by examiner

BEVERAGE TAG

FIELD OF THE INVENTION

The invention relates to an identification device and, more particularly, to a beverage identification device.

BACKGROUND

Many restaurants, bars, and other food eating establishments provide beverages, such as soft drinks, alcoholic beverages, and brewed beverages. Because these beverages are generally not often visually distinguished by brand, the customer cannot always positively identify beverages he or she likes in the container which the beverage is served. Furthermore, with the increasing competition between specialized beverages, such as beers and wines, manufacturers need a way to distinguish their products from the competition.

SUMMARY

Accordingly, a beverage identification device is provided and has an identification member, a rotation member rotatably attached to the identification member, and an attachment mechanism extending from the identification member.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
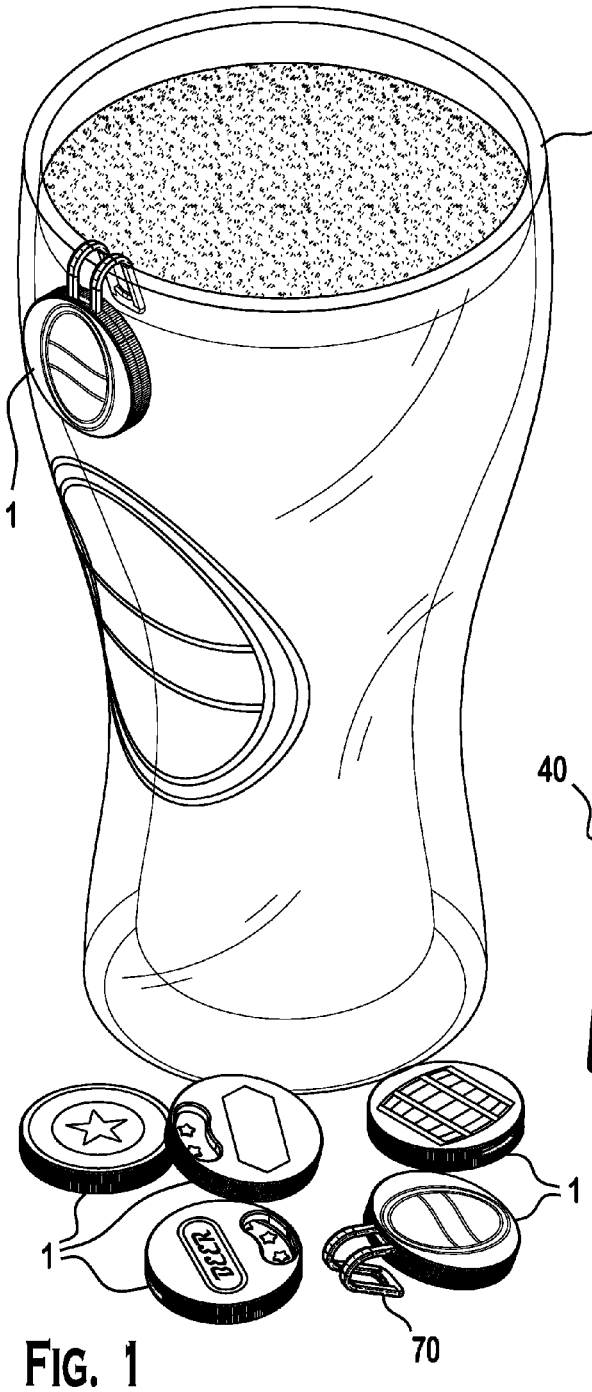
FIG. 1 is a perspective view of a beverage identification device according to the invention, shown attached to a known beverage container.
Figure 2:
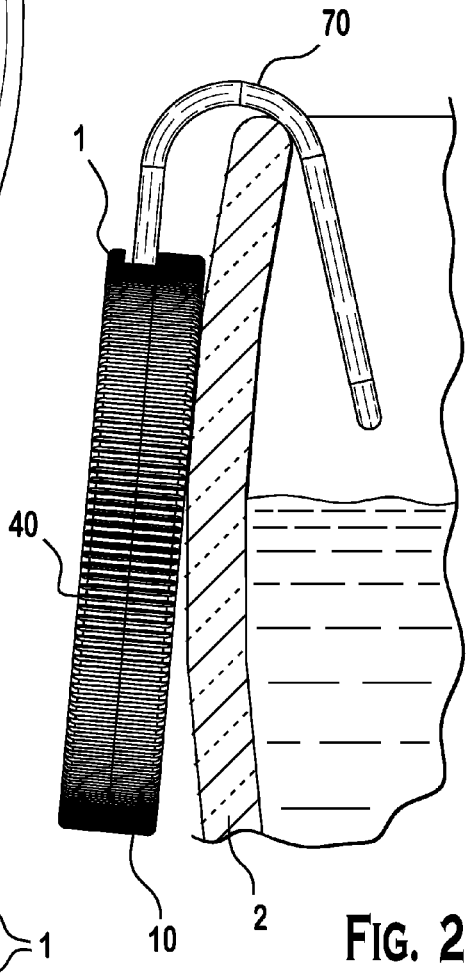
FIG. 2 is a side view of the beverage identification device of FIG. 1.
Figure 3:
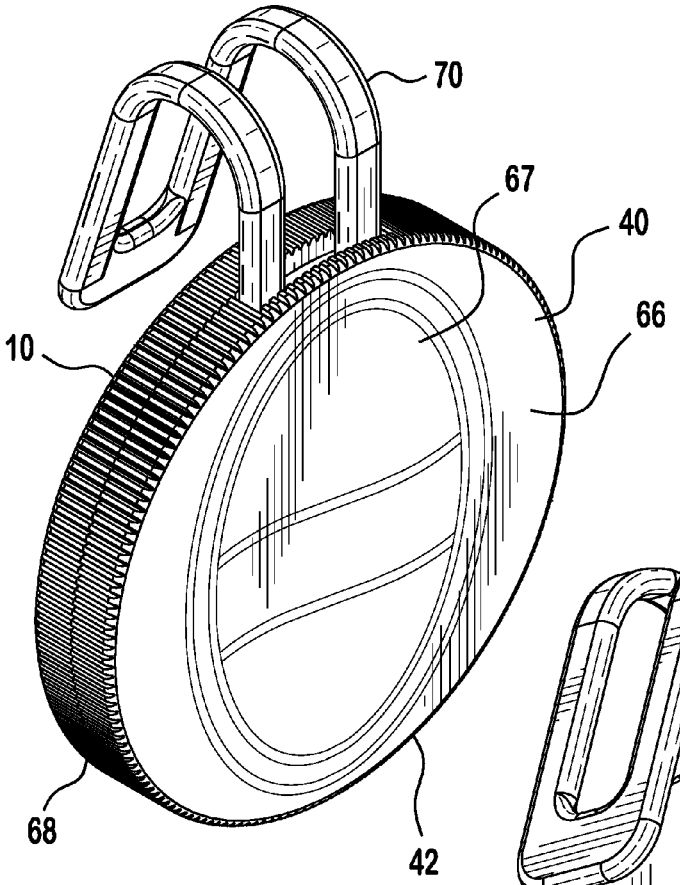
FIG. 3 is a front perspective view of a beverage identification device according to the invention.
Figure 4:
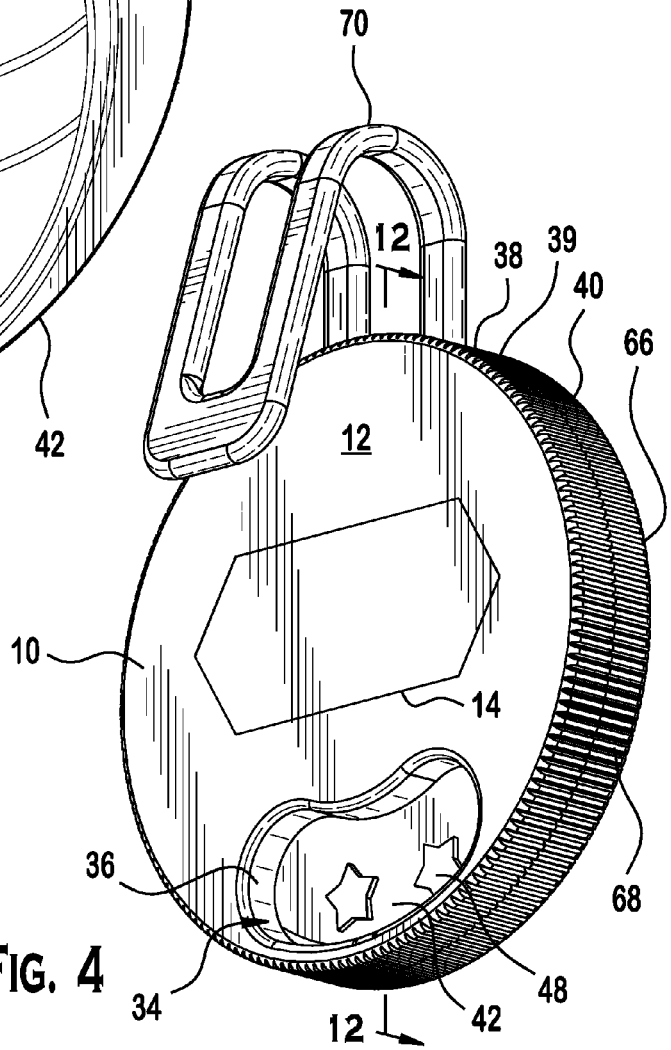
FIG. 4 is a rear perspective view of the beverage identification device of FIG. 3.

In an exemplary embodiment, as shown in the Figures, a beverage identification device 1 for a beverage container 2 is provided.

As shown, the beverage identification device 1 generally has a rotation member 10, an identification member 40, and an attachment mechanism 70.

Now with respect to FIGS. 4 through 11, the rotation member 10 will be described. The rotation member 10 is a flat planar member. In particular, in the shown embodiment, the rotation member 10 is a disc shaped member. However, one skilled in the art should appreciate that the rotation member could have other polygonal shapes.

As shown in the Figures, the rotation member 10 generally has a front side 12, an information display 14, a rear side 16, a rotation member viewing section 34, and an outer wall 38.

The front side 12 is a flat planar surface outside of the beverage identification device 1.

The information display 14 is positioned along the front side 12. The information display 14 is a display of printed indicia, engraved advertisements, or other product information. For instance, the information display 14 may have product information, website information, or other information for a consumer of beverages. The information display 14 may also be a decal that is disposed along the planar surface of the front side 12.

The rear side 16 is opposite the front side 12 and generally has a recessed section 18, a rotation device receiving passageway 20, and a flange 22.

Figure 11:
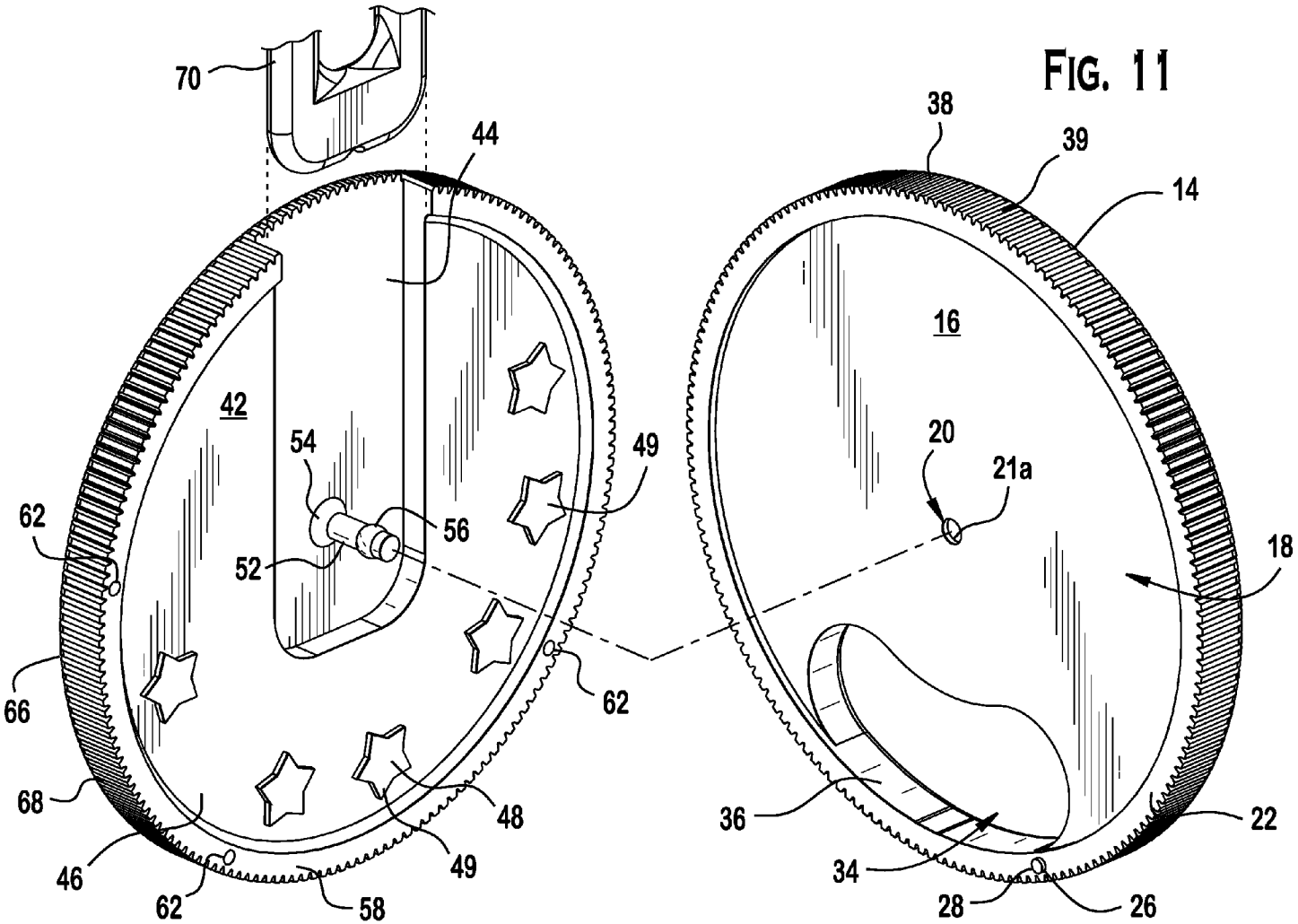
FIG. 11 is an exploded perspective view of a beverage identification device according to the invention.

As shown in FIG. 11, the recessed section 18 is a depression extending from an outer surface of the rear side 16 and toward the front side 12. In the shown embodiment, the recessed section 18 is circular shaped and provides the flange 22 along an outer perimeter thereof. However, one skilled in the art should appreciate that other design are possible and the rear side 16 may be planar and without a recessed section as shown.

As shown in FIG. 11, the flange 22 is a flat rim positioned along the outer perimeter of the rear side 16. The flange 22 provides a flat surface on which the identification member 40 rotates. The flange 22 has a positioning member 26 having one or more protrusions 28 extending outward from the flange 22. As shown, the flange 22 has one protrusion 28 that is a cylindrical protuberance in an exemplary embodiment. The protrusion 28 is sized and shaped to correspond with a plurality of protrusion receiving passageways 62 that are positioned on the identification member 40 (described in further detail below). One skilled in the art should appreciate that other designs are possible. For instance, the positioning member 26 may have a plurality of depressions (not shown) that extend inward from a top surface of the flange 22. Each depression would be sized and shaped to correspond with one or more protuberances positioned on the identification member 40.

Figure 12:
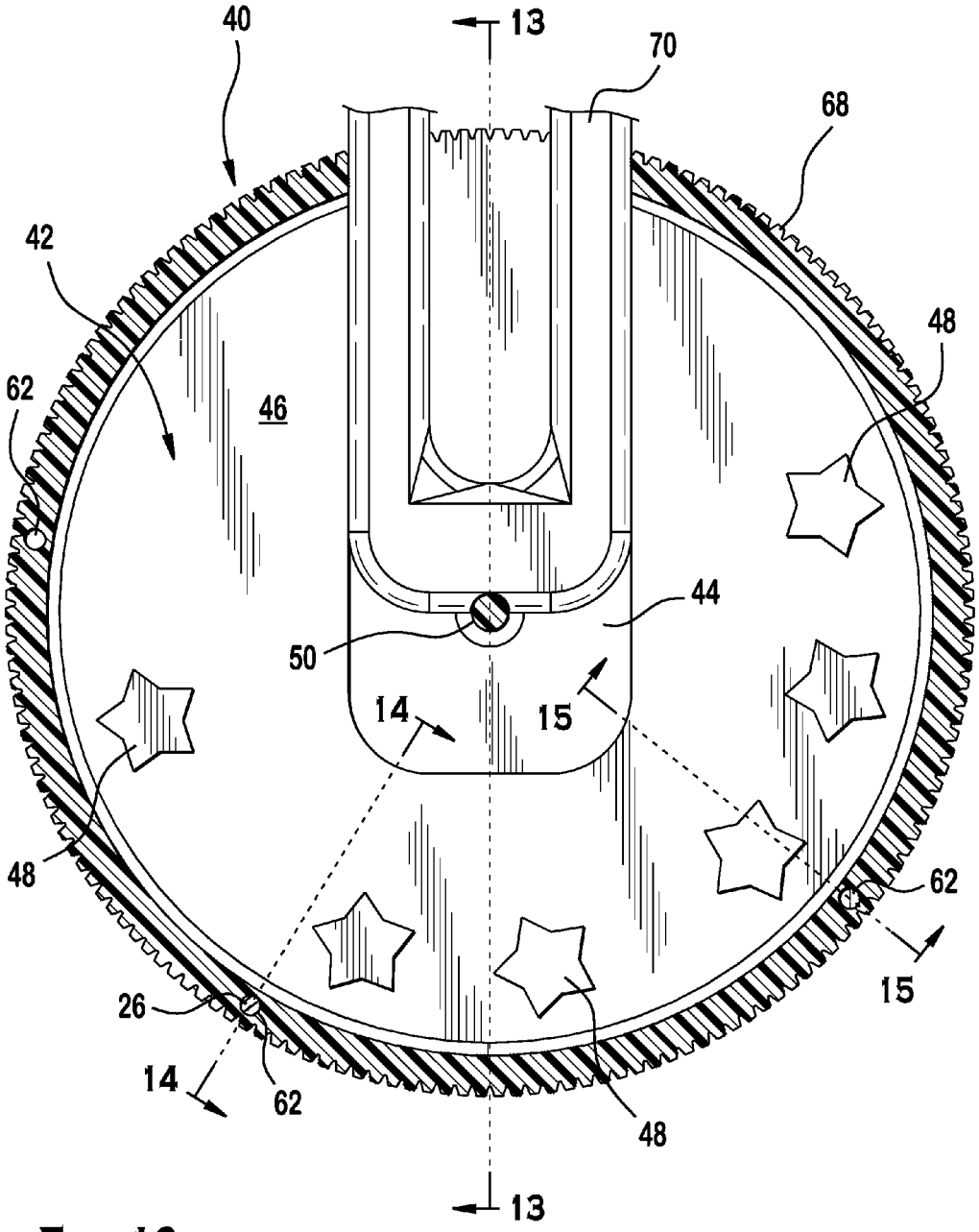
FIG. 12 is sectional view of the beverage identification device of FIG. 4, taken along line 12-12.
Figure 13:
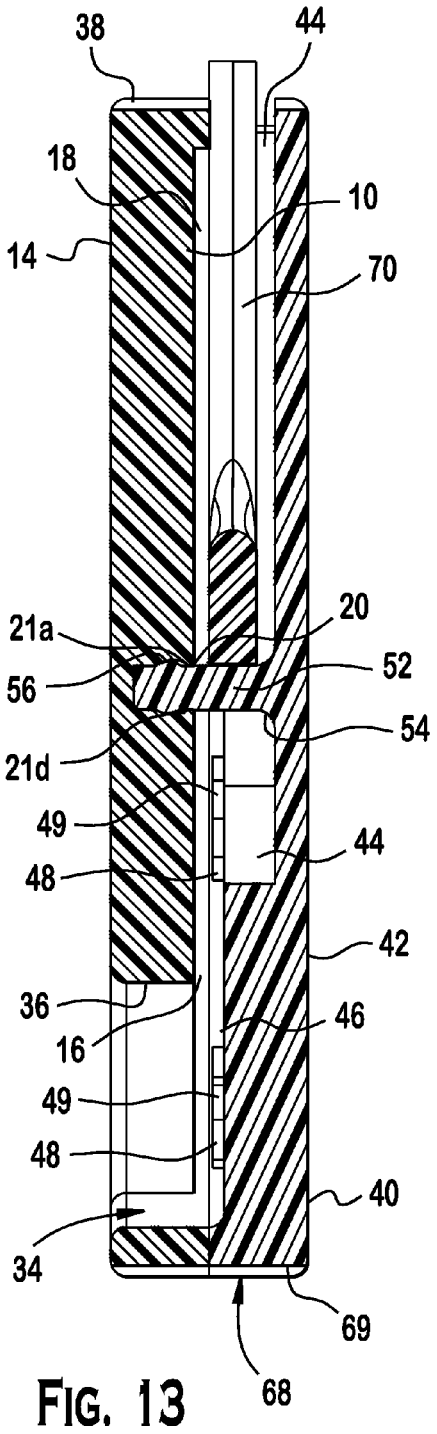
FIG. 13 is sectional view of the beverage identification device of FIG. 12, taken along line 13-13.
Figure 14:
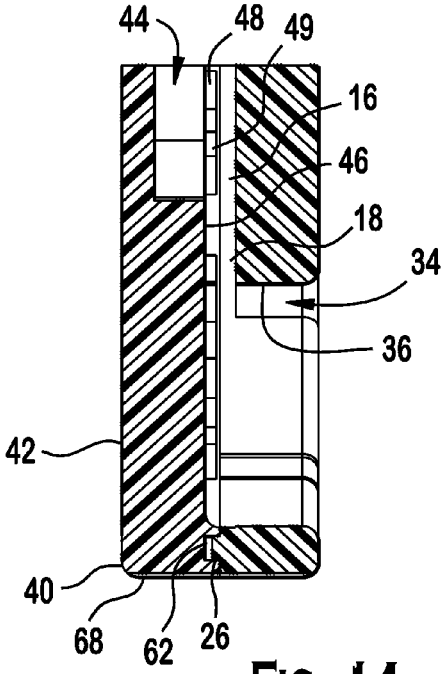
FIG. 14 is sectional view of the beverage identification device of FIG. 12, taken along line 14-14.
Figure 15:
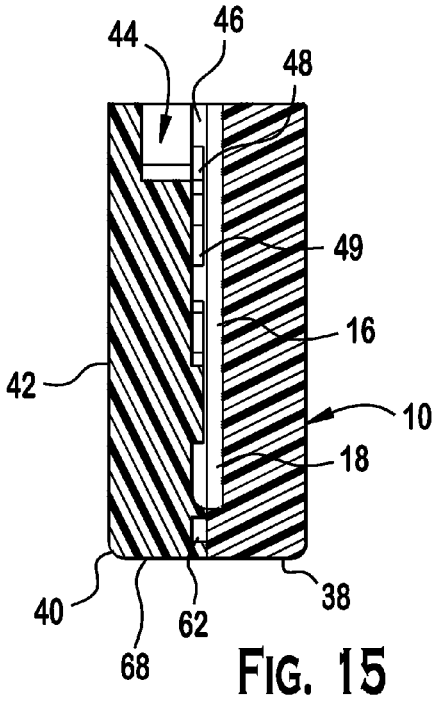
FIG. 15 is sectional view of the beverage identification device of FIG. 12, taken along line 15-15.

As shown in FIG. 11-13, the rotation device receiving passageway 20 has a pin receiving passageway 21*a* and a catch receiving section 21*d*. The pin receiving passageway 21*a* and the catch receiving section 21*d* are positioned and shaped to correspond with a rotation device 50 of the identification member 40 (described in more detail below).

In the shown exemplary embodiment, the rotation device receiving passageway 20 is positioned about a proximate center of the rear side 16 and, more particularly, about a proximate center of the recessed section 18. The pin receiving passageway 21*a* is a cylindrical opening extending from the rear side 16 toward the front side 12. However, in the shown embodiment, the pin receiving passageway 21*a* does not extend completely through the rotation member 10, but to a center section thereof. In the shown embodiment, the catch receiving section 21*d* is doughnut shaped receiving section positioned in the pin receiving passageway 21*a* and extends laterally with respect to the a longitudinal length of the pin receiving passageway 21*a*. The catch receiving section 21*d* is positioned about a middle section of the pin receiving passageway 21*a*.

However, one skilled in the art should appreciate that other designs are possible. For instance, the shape, size and placement of the pin receiving passageway 21*a* and a catch receiving section 21*d* may change depending of the shape, size and placement of the rotation device 50.

As shown in FIGS. 4 through 11, the rotation member viewing section 34 is an opening along the front side 12 and extends through a major surface of the rear side 16. The rotation member viewing section 34 has an inner wall 36 that provide a through hole extending completely through the rotation member 10. In the embodiment shown, the rotation member viewing section 34 is kidney shaped. However, one skilled in the art should appreciate that other designs and shapes are possible. Furthermore, a transparent material may be positioned over the rotation member viewing section 34.

As shown in FIGS. 1-11, the outer wall 38 extends along an outer perimeter of the rotation member 10. The outer wall 38 extends between the front side 12 and the rear side 16. In the shown embodiment, the outer wall 38 has knurled or reeded edges 39 for grip. However, one skilled in the art should appreciate the other design are possible. For instance, the outer wall 38 may have one or more depressions or protuberances to provide relief along the outer edge of the rotation member 10.

Now with respect to FIGS. 1-3 and 11-15, the identification member 40 will be described.

In an exemplary embodiment of the invention, the identification member 40 generally has a front side 42, a rating device 48, a rotation device 50, a rear side 66, and an outer wall 68.

The front side 42 is a flat planar surface positioned on an inner section of the beverage identification device 1. In the shown embodiment, the front side 42 has an attachment mechanism receiving section 44, a recessed section 46, and a flange 58.

As shown in FIG. 11, the recessed section 46 is a depression extending from an outer surface of the front side 42 toward the rear side 66. In the shown embodiment, the recessed section 46 is circular shaped. The recessed section 46 provides the flange 58. However, one skilled in the art should appreciate that other design are possible and the front side 42 may shaped and sized differently.

As shown in FIG. 11, the flange 58 is a projecting flat surface rim positioned along an outer perimeter of the front side 42. The flange 58 provides a surface on which the rotation member 10 rotates. The flange 58 has a positioning member 60 which is one or more protrusion receiving passageways 62 that extend inward from the flange 58. As shown, the flange 58 has three protrusion receiving passageways 62 that are cylindrical depressions. The protrusion receiving passageways 62 are sized and shaped to corresponding with a plurality of protrusions 28 positioned on the rotation member 10. One skilled in the art should appreciate that other design are possible. For instance, the positioning member 60 may have a plurality of protrusions (not shown) extending outward from a top surface of the flange 58. Each protrusion would be sized and shaped to corresponding with one or more depressions positioned on the rotation member 10.

As shown in FIG. 11, the attachment mechanism receiving section 44 is a depression extending further from the outer surface of the front side 42 toward the rear side 66. In the shown embodiment, the attachment mechanism receiving section 44 is boxed shaped and corresponds to the attachment mechanism 70. However, one skilled in the art should appreciate that other design are possible and the attachment mechanism receiving section 44 may shaped and sized differently.

As shown in FIG. 11, the rating device 48 is provided and positioned along a major surface of the recessed section 46. In the shown embodiment, the rating device 48 has a plurality of grouped raised indicia 49 for classification purposes. As shown, a grouping of stars is used for the plurality of grouped raised indicia 49 so the user can rank characteristics of the beverage. For example, one to five stars may be employed to categorize the beverage on appearance, aroma, palate, flavor, quality, or the overall impression, as well as any other the characteristic left to the discretion of the individual user. One skilled in the art should appreciate that other shapes and rating systems known to the art are possible. For instance, a number system may be used, or the indicia can be a set of stickers positioned on the major surface of the recessed section 46.

As shown in FIG. 11, the rotation device 50 is positioned along a major surface of the recessed section 46 and, more particularly, outward from the attachment mechanism receiving section 44. The rotation device 50 generally has an extension 52, an extension support 54, and a stop 56 in the embodiment shown. As shown, the extension 52 extends outward from the attachment mechanism receiving section 44 and is positioned perpendicular to the outer surface of the front side 42. The extension 52 is a cylindrical pin in the embodiment shown.

In the embodiment shown, the extension support 54 is provided along a proximal end of the extension 52. The extension support 54 is a weld extending around the extension 52 to provide support and rigidity. As shown, the extension support 54 is integrally formed with the extension 52. However, one skilled in the art should appreciate that other designs are possible.

As shown in FIG. 11, the rotation device 50 further has the stop 56 positioned along a distal end of the extension 52. The stop 56 is a catch extending about the extension and, in the shown embodiment, doughnut shaped. The stop 56 is integrally formed with extension and approximately positioned inward from the distal end. One skilled in the art should appreciate that other design are possible. For instance, the stop 56 is shaped and sized to correspond with the catch receiving section 21*d*. Therefore, the stop 56 and the catch receiving section 21*d* are keyed to one another, as shown.

The primary indicia 67 are positioned along the rear side 66. The primary indicia 67 are a display of printed indicia or engraved advertisements or information. For instance, the primary indicia 67 may have a trademark, product information, website information, or other information for the consumer concerning the beverage. The primary indicia 67 may also be a decal that is disposed along the planar surface of the rear side 66.

As shown in FIGS. 1-11, the outer wall 68 is positioned along an outer perimeter of the rotation member 10. The outer wall 68 extends between the front side 42 and the rear side 66. In the shown embodiment, the outer wall 68 has reeded edges 69 for grip. However, one skilled in the art should appreciate the other design are possible. For instance, the outer wall 68 may have one or more depressions or protuberances to provide relief along the outer edge of the rotation member 10.

Figure 5:
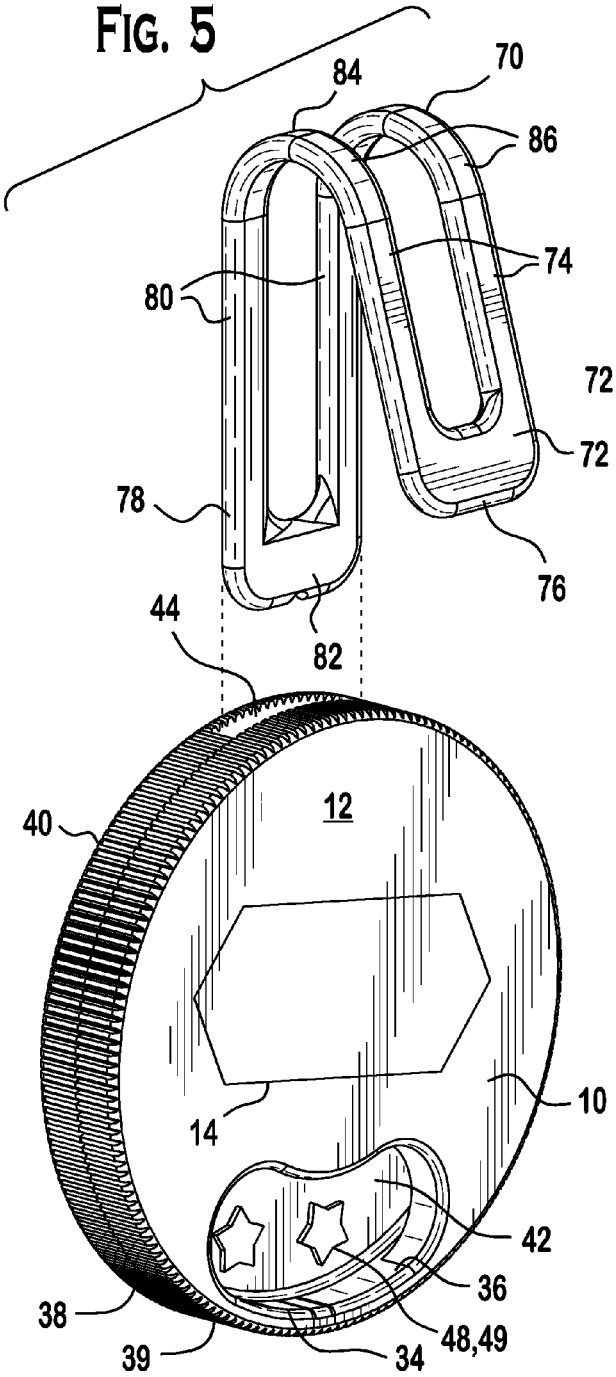
FIG. 5 is another perspective view of a beverage identification device according to the invention, showing an attachment mechanism removed therefrom.
Figure 6:
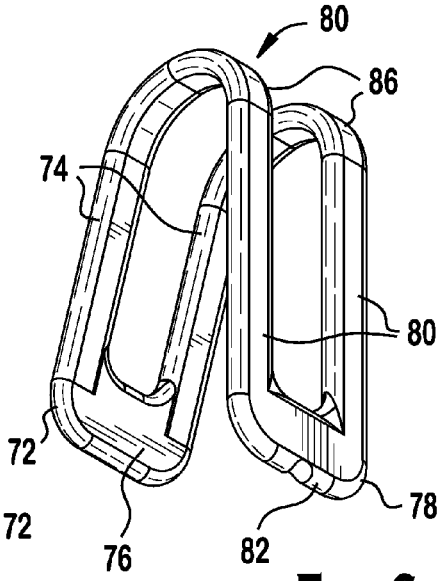
FIG. 6 is a perspective view of the attachment mechanism of FIG. 5.
Figure 7:
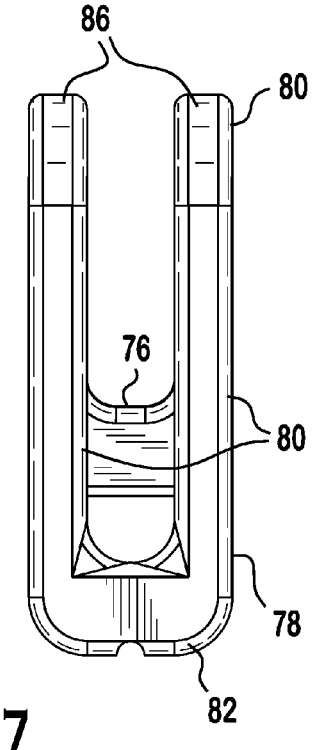
FIG. 7 is a front view of the attachment mechanism of FIG. 5.
Figure 8:
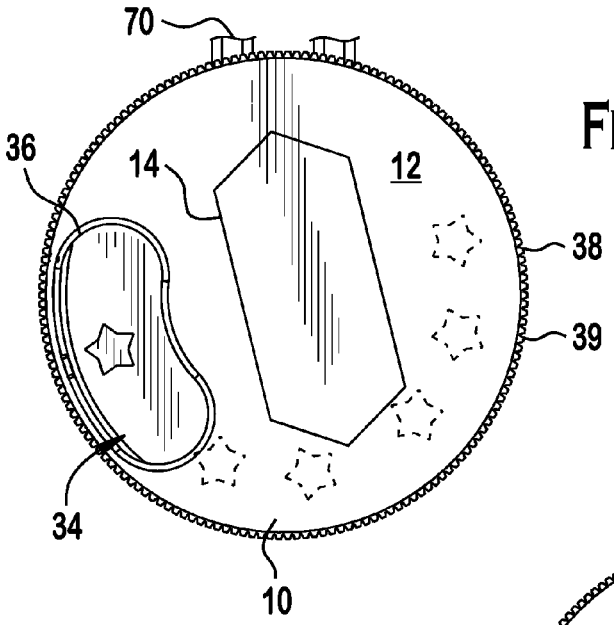
FIG. 8 is a rear view a beverage identification device according to the invention, showing a rotation member rotatably positioned about an identification member.
Figure 9:
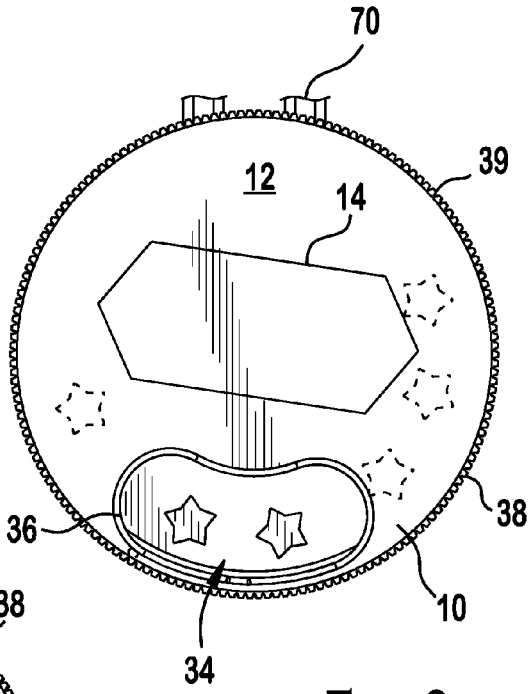
FIG. 9 is another rear view the beverage identification device of FIG. 8, showing the rotation member further rotated about the identification member.
Figure 10:
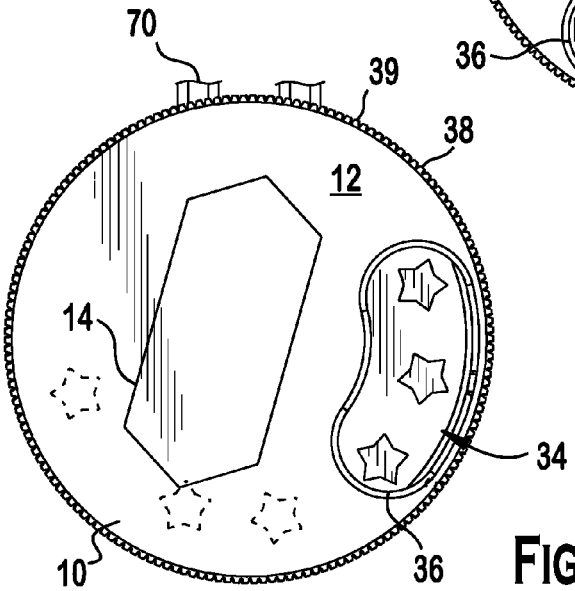
FIG. 10 is yet another rear view the beverage identification device of FIG. 8, further showing rotation of the rotation member about the identification member.

Now with reference to FIGS. 5-7, the attachment mechanism 70 will be described. In the embodiment shown, the attachment mechanism 70 generally has a container connector section 72, a member connector section 78, and a connection section 84. In the shown embodiment, the attachment mechanism 70 is removable from the identification member 40. However, one skilled in the art should appreciate that the other designs are possible. For instance, the attachment mechanism 70 may be permanently secured within the identification member 40 or held by the rotation device 50.

As shown, the container connector section 72 has a pair of resilient outer arms 74 and rigid base 76 connecting the pair of resilient outer arms 74 along a proximal end of the attachment mechanism 70. The pair of resilient outer arms 74 extend parallel to each other and are inwardly elastic in the embodiment shown. For instance, the pair of resilient outer arms 74 can be moved toward each other. One skilled in the art should appreciate that other designs are possible. For instance, the container connection section 72 may be a single arm. Furthermore, the container connector section 72 may be other known means of removable connectors, including fasteners, adhesives, etc. A width of the container connector section 72 is approximately the same as the attachment mechanism receiving section 44.

As shown, the member connector section 78 has a pair of resilient inner arms 80 and rigid base 82 connecting the pair of resilient inner arms 80 along a distal end of the attachment mechanism 70. The pair of resilient inner arms 80 extend parallel to each other and are inwardly elastic in the embodiment shown. For instance, the pair of resilient inner arms 80 can be moved toward each other. As shown, the pair of resilient inner arms 80 are angled with respect to the pair of resilient outer arms 74. One skilled in the art should appreciate that other designs are possible. For instance, the member connector section 78 may be a single arm connected to the pair of resilient outer arms 74. Furthermore, the member connector section 78 may be other known means of connection, including fasteners, adhesives, etc.

As shown, the connection section 84 has a pair of connecting arms 86 connecting the pair of resilient inner and outer arms 74, 80. The pair of resilient connecting arms 86 extend parallel to each other and are inwardly elastic in the embodiment shown. For instance, the pair of resilient connecting arms 86 can be moved toward each other. As shown, the pair of resilient connecting arms 86 are u-shaped such that the pair of resilient outer arms 74 and the pair of resilient inner arms 80 are angled with respect to each other. One skilled in the art should appreciate that other designs are possible. For instance, the connection section 84 may be a single arm connected to the container connector section 72 and the member connector section 78. In other embodiments, the container connector section 72 and the member connector section 78 can be directly connected to each other.

Now with reference to Figures, assembly of the beverage identification device 1 will be described.

Generally, the rotation member 10 and the identification member 40 are connected together using the rotation device 50 and the rotation device receiving passageway 20. The flange 22 along the rear side 16 of the rotation member 10 is positioned on the flange 58 of the front side 42 of the identification member 40. The rotation device 50 is positioned in the rotation device receiving passageway 20. In particular, the extension 52 is positioned through the pin receiving passageway 21*a* and the stop 56 is received by the catch receiving section 21*d* to hold the extension 52 in the pin receiving passageway 21*a*. The rotation member 10 abuts the identification member 40 and is allowed to rotate there about. The positioning member 26 is positioned in one of the plurality of protrusion receiving passageways 62 positioned on the identification member 40 and one of the raised indicia 49 of the rating device 48 is visible through the rotation member viewing section 34. The member connector section 78 is then positioned in the attachment mechanism receiving section 44 and held in the identification member 40 by a friction fit connection in the shown embodiment. However, one skilled in the art should appreciate that the attachment mechanism 70 may be secured to the identification member 40 using various known connection means, including fasteners, adhesives, etc.

Now with reference to Figures, use of the beverage identification device 1 will be described.

A server positions the beverage identification device 1 on the beverage container 2 using the attachment mechanism 70. In the embodiment shown, the container connector section 72 is united with the beverage container 2 and, more particularly, hung from a rim of the beverage container 2. However, one skilled in the art should appreciate that the attachment mechanism 70 may be united with the beverage container 2 using various known connection means, including fasteners, adhesives, etc.

The user can remove the identification device 1 from the beverage container 2 and review information concerning the beverage in the beverage container 2 using the information display 14 and the primary indicia 67.

The user then rates the beverage by rotating the rotation member 10 about the identification member 40 such that the positioning member 26 is positioned in one of the plurality of protrusion receiving passageways 62. The user then selects which of the raised indicia 49 of the rating device 48 is visible through the rotation member viewing section 34.

As shown in FIG. 1, the user can remove the attachment mechanism 70 for disposal and collect several beverage identification devices 1 for further review at a later time.

While the invention has been described in detail and with reference to specific embodiments, one of ordinary skill in the art would appreciate that the described embodiments are illustrative, and that various changes and modifications can be made without departing from the scope of the invention.

What is claimed is:

1. A beverage identification device comprising:

an identification member having a planar inner surface, a flange positioned about the planar inner surface, a plurality of indicia on the identification member positioned along a planar inner surface thereof;

a rotation device secured to the identification member;

a rotation member rotatably attached to the rotation device and having an identification member viewing section extending through a front side and a rear side thereof and corresponding to one set of indicia of a plurality of indicia on the identification member; and an attachment mechanism adapted for a beverage container and extending from the identification member.

2. The beverage identification device of claim 1, wherein the rotation member has a rotation device receiving passageway engaging the rotation device.

3. The beverage identification device of claim 1, wherein the rotation device receiving passageway has a pin receiving passageway and a catch receiving section positioned in the pin receiving passageway.

4. The beverage identification device of claim 3, wherein the pin receiving passageway is a cylindrical opening extending from a rear side thereof.

5. The beverage identification device of claim 4, wherein the catch receiving section is a doughnut shaped receiving section extending laterally from and about a middle section of the pin receiving passageway.

6. The beverage identification device of claim 3, wherein the rotation device corresponds with the rotation device receiving passageway.

7. The beverage identification device of claim 6, wherein the rotation device has an extension extending from a front side thereof and having a stop positioned along a distal end of the extension.

8. The beverage identification device of claim 7, wherein the stop is a doughnut shaped catch extending about the extension and corresponding with the catch receiving section.

9. The beverage identification device of claim 8, wherein the stop and the catch receiving section are keyed to one another.

10. The beverage identification device of claim 1, wherein the identification member viewing section is a kidney shaped window.

11. The beverage identification device of claim 10, wherein the plurality of indicia are positioned along a recessed section of the planar inner surface.

12. The beverage identification device of claim 11, wherein the flange has a plurality of protrusion receiving passageways.

13. The beverage identification device of claim 11, wherein the rotation member has the rotating flange includes a positioning member disposed along a surface thereof.

14. The beverage identification device of claim 13, wherein the positioning member has a protrusion extending outward from the rotating flange corresponding with the plurality of protrusion receiving passageways.

15. The beverage identification device of claim 1, wherein the attachment mechanism is removable.

16. A beverage identification and rating device comprising:

a beverage identification and rating unit having:

a display indicating a beverage identification;

a beverage rating scale;

a cover mounted for movement relative to the beverage scale and having an opening through which the beverage rating scale can be viewed; and a positioning member by which the cover is fixed to the beverage rating scale along a selected point on the beverage rating scale; and a beverage container attachment unit secured to the beverage identification and rating unit.

17. A method of a rating a beverage in a beverage container comprising the steps of: providing:

a beverage identification and rating unit having:

(a) a display indicating a beverage identification;

(b) a beverage rating scale;

(c) a cover mounted for movement relative to the beverage scale and having an opening through which the beverage rating scale can be viewed; and (d) a positioning member by which the cover is fixed to the beverage rating scale along a selected point on the beverage rating scale; and a beverage container attachment unit secured to the beverage identification and rating unit;

placing the beverage identification and rating unit device on a beverage container in which a beverage has been deposited by means of the beverage glass attachment unit;

viewing the beverage rating scale through the opening in the cover;

moving the cover of the beverage identification and rating unit to a selected position on the rating scale; and fixing the cover relative to the beverage rating scale at the selected position on the beverage rating scale.

18. A beverage identification device comprising:

an identification member having a plurality of indicia disposed along a recessed section thereof and a flange disposed along an outer perimeter of the recessed section having a plurality of protrusion receiving passageways;

a rotation member rotatably attached to the identification member and having a flange corresponding to the flange of the identification member and a positioning member disposed along a surface of the flange of the rotation member; and an attachment mechanism adapted for a beverage container and extending from the identification member.

19. The beverage identification device of claim 18, wherein the positioning member has a protrusion extending outward from the flange of the rotation member corresponding with the plurality of protrusion receiving passageways.

20. A beverage identification device comprising:

an identification member having an attachment mechanism receiving section extending from an outer surface of a front side toward a rear side thereof;

a rotation device secured to the identification member;

a rotation member rotatably attached to the rotation device and having a front side, a rear side, a rotation device receiving passageway engaging the rotation device; and an attachment mechanism adapted for a beverage container and having a container connector section fit with the identification member and a member connector section extending out and away from the identification member;

wherein the attachment mechanism receiving section is a boxed shaped notch corresponding to the attachment mechanism.

21. The beverage identification device of claim 20, wherein the container connector section has a pair of resilient outer arms and a rigid base connecting the pair of resilient outer arms along a proximal end of the attachment mechanism.

22. The beverage identification device of claim 21, wherein the member connector section has a pair of resilient inner arms and a rigid base connecting the pair of resilient inner arms along a distal end of the attachment mechanism.

23. The beverage identification device of claim 20, wherein the attachment mechanism further has a connection section connecting the container connector section and the member connector section.

24. The beverage identification device of claim 23, wherein the connection section has a pair of resilient connecting arms connecting the pair of resilient inner and outer arms.

25. The beverage identification device of claim 24, wherein the pair of resilient connecting arms are u-shaped such that the pair of resilient outer arms and the pair of resilient inner arms are angled with respect to each other.

* * * * *